US009704429B2

(12) United States Patent
Seo et al.

(10) Patent No.: US 9,704,429 B2
(45) Date of Patent: Jul. 11, 2017

(54) DISPLAY DEVICE

(71) Applicant: Samsung Display Co., Ltd., Yongin-si, Gyeonggi-do (KR)

(72) Inventors: Youngwan Seo, Suwon-si (KR); Ji-sun Kim, Seoul (KR); Jaekeun Lim, Swuon-si (KR); Jonghee Kim, Yongin-si (KR); Chongchul Chai, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 14/857,747

(22) Filed: Sep. 17, 2015

(65) Prior Publication Data

US 2016/0267831 A1 Sep. 15, 2016

(30) Foreign Application Priority Data

Mar. 13, 2015 (KR) ..... 10-2015-0035107

(51) Int. Cl.
*G09G 3/36* (2006.01)
*G09G 3/20* (2006.01)

(52) U.S. Cl.
CPC ... *G09G 3/2085* (2013.01); *G09G 2300/0426* (2013.01); *G09G 2300/08* (2013.01); *G09G 2310/0267* (2013.01)

(58) Field of Classification Search
CPC .. G09G 3/2085; G09G 3/3655; G09G 3/3607; G09G 5/10; G09G 2300/0452; G09G 2300/0465; G09G 2320/0233
USPC ..... 345/87–89, 204, 76, 98, 100
See application file for complete search history.

(56) References Cited

U.S. PATENT DOCUMENTS

| | | | | |
|---|---|---|---|---|
| 8,717,523 | B2 | 5/2014 | Lee et al. | |
| 2009/0102997 | A1* | 4/2009 | Wen | G09G 3/3648 349/54 |
| 2014/0152938 | A1 | 6/2014 | Lee et al. | |
| 2016/0210923 | A1* | 7/2016 | Yoshida | G09G 3/3677 |

FOREIGN PATENT DOCUMENTS

| | | | |
|---|---|---|---|
| KR | 2007-0058826 | A | 6/2007 |
| KR | 10-1097601 | B1 | 12/2011 |
| KR | 10-2013-0067915 | A | 6/2013 |
| KR | 10-2013-0135043 | A | 12/2013 |
| WO | WO 2014-069529 | A1 | 5/2014 |

* cited by examiner

*Primary Examiner* — Jennifer Nguyen
(74) *Attorney, Agent, or Firm* — Lewis Roca Rothgerber Christie LLP

(57) ABSTRACT

A display device includes: a display panel having a display area and a non-display area; a plurality of pixels on the display area to emit light, wherein pixels arranged along a first direction are defined as first pixel groups and pixels arranged along a second direction are defined as second pixel groups; gate driving units on the display area to generate gate signals, wherein the gate driving units include first and second gate driving units corresponding one-to-one with each other; a data driver on the non-display area to generate data signals; a plurality of first lines to transmit the data signals to the plurality of pixels; and a plurality of second lines to transmit driving start signals from the first gate driving units to the second gate driving units respectively corresponding to the first gate driving units, wherein the first or second lines are between the first groups.

17 Claims, 5 Drawing Sheets

DISPLAY DEVICE

CROSS-REFERENCE TO RELATED APPLICATIONS

This patent application claims priority to and the benefit of Korean Patent Application No. 10-2015-0035107, filed on Mar. 13, 2015, the entire content of which is hereby incorporated by reference.

BACKGROUND

One or more aspects of embodiments of the present disclosure relate to a display device.

A liquid crystal display device, an organic light emitting display device, a plasma display device, and an electrophoretic display device are being used as various kinds of display devices. These display devices generally include a display panel and a driving unit for driving the display panel, and are becoming increasingly lighter and thinner according to the needs of customers.

Furthermore, a portion of the driving unit which drives the display panel may be integrated in the display panel in order to reduce manufacturing costs. Since there is not a separate chip for forming the driving unit, and a portion of the driving unit is integrated together with the fabrication of the display panel, manufacturing costs of the display device may be reduced. For example, a gate driving unit, which generates scan signals, and a data driving unit, which transmits data signals, may be integrated concurrently (e.g., simultaneously) with the display panel.

Also, customers are demanding a display device having a narrow bezel, as a premium display device. A wider bezel makes a display area displaying images look relatively smaller, and may be a limitation in manufacturing a tiled display device.

Thus, it may be desired to minimize the bezel width of the display device.

The above information disclosed in this Background section is only for enhancement of understanding of the background of the present inventive concept, and therefore, it may contain information that does not form prior art.

SUMMARY

One or more aspects of the present disclosure are directed toward a display device in which a plurality of pixels and signal transmission lines are effectively disposed on a display area.

One or more embodiments of the inventive concept provide a display device including: a display panel having a display area and a non-display area; a plurality of pixels on the display area and configured to emit light, wherein pixels from among the plurality of pixels arranged with each other along a first direction are defined as first pixel groups and pixels from among the plurality of pixels arranged with each other along a second direction are defined as second pixel groups; gate driving units on the display area and configured to generate gate signals, wherein the gate driving units include first and second gate driving units corresponding one-to-one with each other; a data driver on the non-display area and configured to generate data signals; a plurality of first lines configured to transmit the data signals to the plurality of pixels; and a plurality of second lines configured to transmit driving start signals from the first gate driving units to the second gate driving units respectively corresponding to the first gate driving units, wherein the first or second lines are between the first pixel groups.

In one embodiment, the plurality of first and second lines may extend in the first direction.

In one embodiment, the plurality of first and second lines may be alternately arranged with each other along the second direction.

In one embodiment, the plurality of first and second lines may face each other with the first pixel groups therebetween.

In one embodiment, the data driver, the gate driving units, and the second pixel groups may be arranged with each other along the first direction on the display panel.

In one embodiment, corresponding ones of the first and second gate driving units may be arranged at respective sides of a corresponding one of the second pixel groups.

In one embodiment, each of the second pixel groups may be configured to be driven by receiving the gate signals from the corresponding ones of the first and second gate driving units.

In one embodiment, the second gate driving units may be configured to start to be driven by the driving start signals received from the first gate driving units via the plurality of second lines connected thereto.

In one embodiment, each of the first and second gate driving units may include at least one gate driver.

In one embodiment, each of the gate drivers may include a driving start signal input terminal, a gate signal output terminal, and a driving start signal output terminal.

In one embodiment, the driving start signal input terminal of a current gate driver of the gate drivers may be configured to receive a first driving start signal from a previous gate driver of the gate drivers via a second line of the second lines connected thereto, and the driving start signal output terminal of the current gate driver may be configured to output a second driving start signal to a next gate driver of the gate drivers via a second line of the second lines connected thereto.

In one embodiment, the previous gate driver, the current gate driver, and the next gate driver may be sequentially arranged with each other along the first direction.

In one embodiment, the first lines may be between the first pixel groups, and corresponding ones of the first pixel groups arranged at respective sides of a corresponding one of the first lines may be connected to the corresponding one of the first lines arranged between the corresponding ones of the first pixel groups.

In one embodiment, the corresponding ones of the first pixel groups at the respective sides of the corresponding one of the first lines may receive the data signals via the corresponding one of the first lines arranged between the corresponding ones of the first pixel groups.

BRIEF DESCRIPTION OF THE FIGURES

Aspects of embodiments of the inventive concepts will become more apparent in view of the attached drawings and accompanying detailed description.

DETAILED DESCRIPTION

Figure 1:
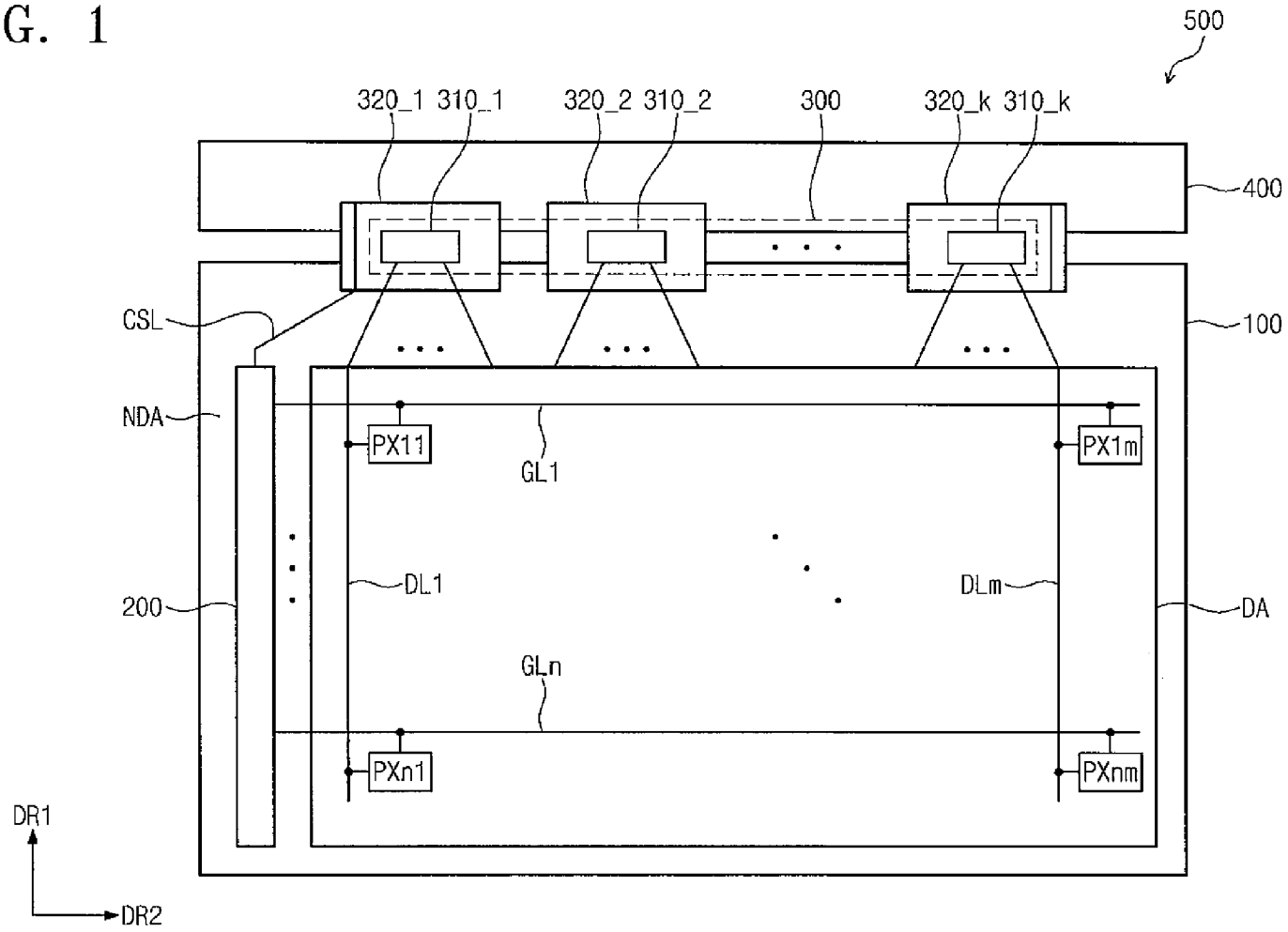
FIG. 1 is a plan view of a display device.

Hereinafter, example embodiments will be described in more detail with reference to the accompanying drawings, in which like reference numbers refer to like elements throughout. The present inventive concept, however, may be embodied in various different forms, and should not be construed as being limited to only the illustrated embodiments herein. Rather, these embodiments are provided as examples so that this disclosure will be thorough and complete, and will fully convey the aspects and features of the present inventive concept to those skilled in the art. Accordingly, processes, elements, and techniques that are not necessary to those having ordinary skill in the art for a complete understanding of the aspects and features of the present inventive concept may not be described. Unless otherwise noted, like reference numerals denote like elements throughout the attached drawings and the written description, and thus, descriptions thereof may not be repeated.

Unless otherwise defined, all terms (including technical and scientific terms) used herein have the same meaning as commonly understood by one of ordinary skill in the art to which the inventive concept belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Figure 2:
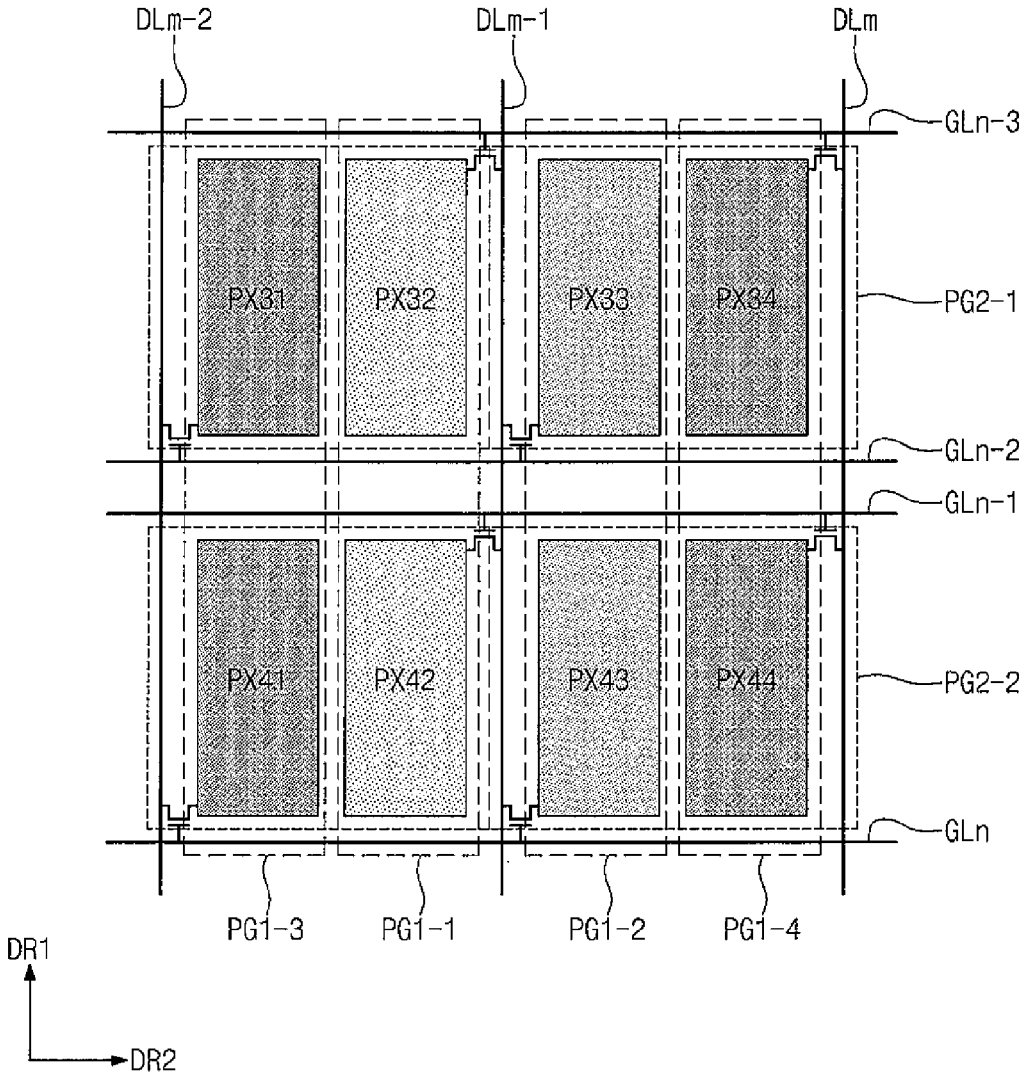
FIG. 2 is an expanded view of a display area illustrated in FIG. 1.
Figure 3:
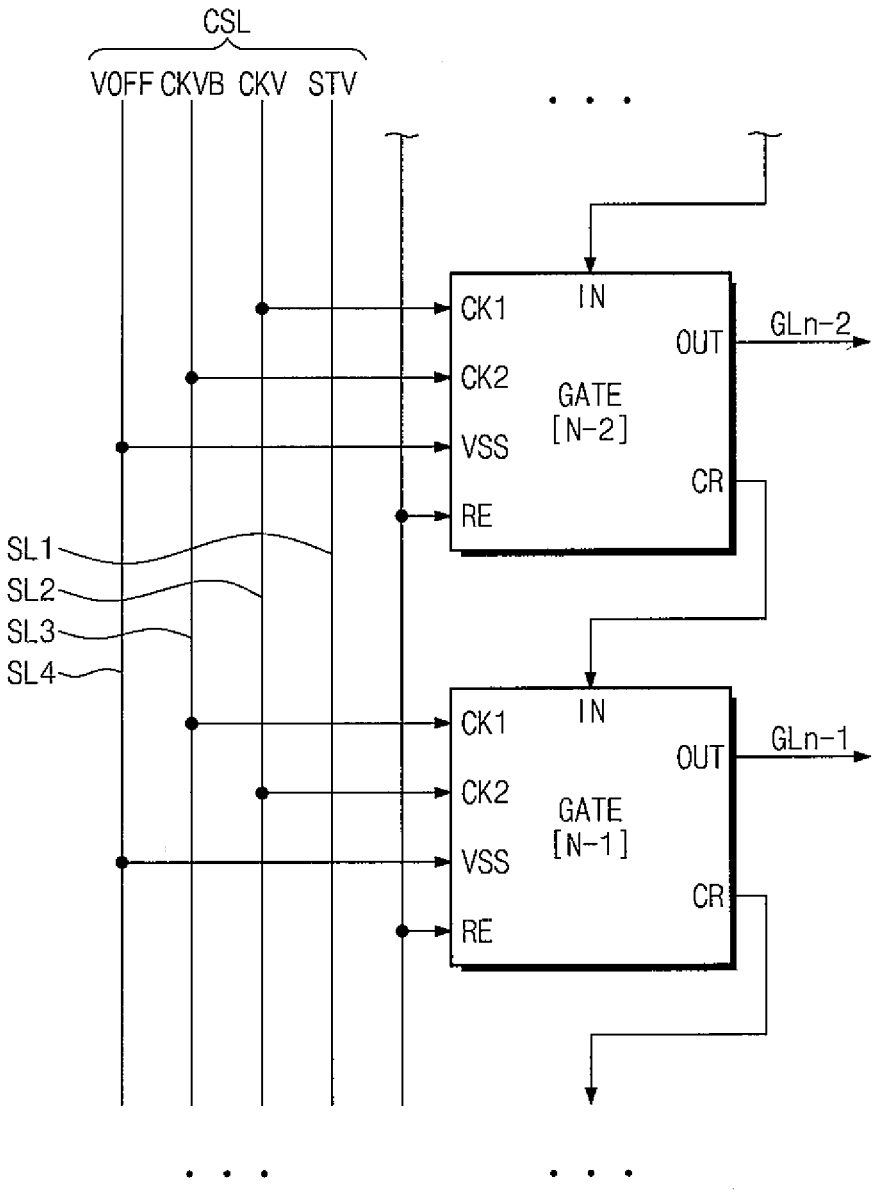
FIG. 3 is a block diagram of a gate driving unit illustrated in FIG. 1.

FIG. 1 is a plan view of a display device. FIG. 2 is an expanded view of a display area illustrated in FIG. 1. FIG. 3 is a block diagram of a gate driving unit illustrated in FIG. 1.

Referring to FIG. 1, a display device 500 includes a display panel 100, a gate driving unit (e.g., a gate driver) 200, a data driving unit (e.g., a data driver) 300, and a driving circuit board 400.

The display panel 100 includes a display area DA on which a plurality of pixels PX11 to PXnm are arranged in a matrix form, a non-display area NDA surrounding the display area DA, a plurality of gate lines GL1 to GLn, a plurality of data lines DL1 to DLm crossing the gate lines GL1 to GLn, and a control signal line unit (or control signal line) CSL.

The gate lines GL1 to GLn may be connected to the gate driving unit 200 to sequentially receive gate signals. The data lines DL1 to DLm may be connected to the data driving unit 300 to receive data signals (e.g., analogue data signals).

The plurality of pixels PX11 to PXnm are formed at regions where the gate lines GL1 to GLn and the data lines DL1 to DLm cross each other. The plurality of pixels PX11 to PXnm are respectively connected to corresponding gate lines GL1 to GLn and corresponding data lines DL1 to DLm. Each of the plurality of pixels PX11 to PXnm receives a data signal provided through a corresponding data line in response to a gate signal provided through a corresponding gate line. As a result, each of the plurality of pixels PX11 to PXnm may display a grayscale level corresponding to the data signals to display an image.

For example, referring to FIG. 2, the plurality of pixels PX31 to PX34 and PX41 to PX44 may be arranged in first and second directions DR1 and DR2. Herein, the plurality of pixels arranged with each other in the first direction DR1 may be referred to as first pixel groups PG1-1 to PG1-4, and the plurality of pixels arranged with each other in the second direction DR2 may be referred to as second pixel groups PG2-1 and PG2-2. Data lines DLm-2 to DLm may extend in the first direction DR1. In this case, the data lines DLm-2 to DLm may be disposed between the first pixel groups PG1-1 to PG1-4 at every two first pixel groups. First pixel groups PG1-1 and PG1-2 which are respectively disposed at sides (e.g., left and right sides) of one data line DLm-1 may be connected to the one data line DLm-1 to receive data signals.

Gate lines GLn-3 to GLn may extend in the second direction DR2 different from the first direction DR1. The gate lines GLn-3 to GLn may correspond to the second pixel groups PG2-1 and PG2-2 in units of two gate lines each. In this case, the two gate lines GLn-1 and GLn may be respectively disposed at sides (e.g., upper and lower sides) of the corresponding second pixel group PG2-2. The plurality of pixels PX41 to PX44 in the second pixel group PG2-2 may be alternately connected to (e.g., for every pixel) the gate lines GLn-1 and GLn disposed at the respective sides. Therefore, the plurality of pixels PX41 to PX44 in the second pixel group PG2-2 may respectively receive different gate signals at every pixel. Furthermore, the plurality of pixels PX32, PX33, PX42, and PX43 in the first pixel groups PG1-1 and PG1-2, which are connected to the same data line DLm-1, are respectively connected to different gate lines GLn-3 to GLn, and thus, may be driven at different times.

Referring to FIG. 1 again, the control signal line unit CSL is connected to the gate driving unit 200 and a flexible printed circuit board 320-1, which is disposed at the leftmost side between the driving circuit board 400 and the display panel 100. The control signal line unit CSL may receive control signals from a timing controller mounted on the driving circuit board 400. The control signals are provided to the gate driving unit 200 via the control signal line unit CSL.

The gate driving unit 200 may be disposed on the non-display area NDA adjacent to a side of the display area DA. For example, the gate driving unit 200 may be mounted in the form of an amorphous silicon TFT gate driver circuit (ASG) on the non-display area NDA adjacent to the left side of the display area DA.

When the gate driving unit 200 is disposed on the non-display area NDA at a side of the display area DA, the freedom to vary the shape of the display panel 100 is limited, which may result in a wider bezel. According to some embodiments of the inventive concept, the gate driving unit is disposed within the display area DA, unlike the gate driving unit described above, thereby allowing greater freedom to vary the shape and to reduce the bezel width. The display area DA on which the gate driving unit is disposed, according to some embodiments, will be described later with reference to FIG. 4.

The gate driving unit 200 generates gate signals in response to control signals provided via the control signal line unit CSL. The gate driving unit 200 sequentially provides gate signals to the plurality of pixels PX11 to PXnm through the gate lines GL1 to GLn. As a result, the plurality of pixels included in each first pixel group may be sequentially driven.

Referring to FIG. 3, the gate driving unit may include a plurality of gate drivers ( . . . , GATE[N−2], GATE[N−1], . . . ) which have a cascade connection. In the drawing, although only (N−2)-th and (N−1)-th gate drivers are illustrated for convenience of description, the rest of the gate drivers may also have a cascade connection in the same manner as above. Each of the gate drivers is electrically connected to each other to start to be driven by a first driving start signal received from the previous gate driver GATE [N−2], and outputs a gate signal and a second driving start signal for starting the driving of the next gate driver GATE [N−1]. As a result, the gate drivers ( . . . , GATE[N−2], GATE[N−1], . . . ) having a cascade connection output gate signals to sequentially drive each pixel.

For example, each of the gate drivers ( . . . , GATE[N−2], GATE[N−1], . . . ) includes first and second clock terminals CK1 and CK2, an off voltage terminal VSS, a reset terminal RE, a driving start signal output terminal CR, a gate signal output terminal OUT, and a driving start signal input terminal IN.

The first and second clock terminals CK1 and CK2 receive clock signals that may be in anti-phase with each other. For example, first clock terminals CK1 of odd-numbered gate drivers GATE[N−2] receive first clock signals CKV, and second clock terminals CK2 thereof receive second clock signals CKVB in anti-phase with the first clock signals CKV. First clock terminals CK1 of even-numbered gate drivers GATE[N−1] receive the second clock signals CKVB, and second clock terminals CK2 thereof receive the first clock signals CKV.

Each of the driving start signal input terminals IN of the rest of the gate drivers (GATE[2], . . . , GATE[N−2], GATE[N−1], . . . ), other than the first gate driver GATE[], receives a first driving start signal that is output from a driving start signal output terminal CR of the previous gate driver (e.g., GATE[N−2]). The driving start signal serves to start the driving of the gate driver receiving the driving start signal. The first gate driver GATE[] starts to be driven by a vertical start signal STV received from the timing controller.

The off voltage terminals VSS of the gate drivers receive an off voltage VOFF or a ground voltage. The reset terminals RE of the gate drivers receive (e.g., commonly receive) a second driving start signal output from a driving start signal output terminal CR of the last gate driver.

When the first and second clock signals CKV and CKVB are at a high level, the signals may serve as gate-on voltages. On the other hand, when the first and second clock signals CKV and CKVB are at a low level, the signals may serve as gate-off voltages. The gate drivers ( . . . , GATE[N−2], GATE[N−1], . . . ) output high level sections of the clock signals provided to the first clock terminals CK1.

For example, gate signal output terminals OUT of odd-numbered gate drivers may output a high level section of the first clock signal CKV. In this case, the output signal is a gate signal that is transmitted to each of the plurality of pixels connected to odd-numbered gate lines which are respectively connected to the gate signal output terminals OUT of the odd-numbered gate drivers. The gate signal output terminals OUT of even-numbered gate drivers may output a high level section of the second clock signal CKVB. In this case, the output signal is a gate signal that is transmitted to each of the plurality of pixels connected to even-numbered gate lines which are respectively connected to the gate signal output terminals OUT of the even-numbered gate drivers.

The driving start signal output terminals CR of the gate drivers ( . . . , GATE[N−2], GATE[N−1], . . . ) output second driving start signals based on the gate signals output from the gate signal output terminals OUT.

In addition, the gate drivers are not limited to the aforementioned embodiments, but may selectively include the aforesaid terminals, or may include additional terminals according to embodiments of the inventive concept.

The control signal line unit CSL may include a first control line SL1 which receives the vertical start signal STV, a second control line SL2 which receives the first clock signal CKV, a third control line SL3 which receives the second clock signal CKVB, and a fourth control line SL4 which receives the off voltage VOFF.

Referring back to FIG. 1, the data driving unit 300 receives data control signals from the timing controller, and generates data signals (e.g., analogue data signals) corresponding to the data control signals. The data driving unit 300 provides the data signals to the plurality of pixels PX11 to PXnm through the data lines DL1 to DLm.

The data driving unit 300 includes a plurality of source driving chips 310_1 to 310_k. Herein, k is an integer greater than zero and less than m. The source driving chips 310_1 to 310_k are mounted on corresponding flexible circuit boards 320_1 to 320_k, and connected to the non-display area NDA adjacent to the driving circuit board 400 at the upper portion of the display area DA.

The display device 500 in which the gate drivers are disposed on the non-display area NDA has been described above. Hereinafter, a display device in which gate drivers are disposed on the display area DA will be described, according to some embodiments of the inventive concept. The foregoing description with respect to FIGS. 1 to 3 may be applicable in the following description, and thus, repeat description thereof may be omitted.

Figure 4:
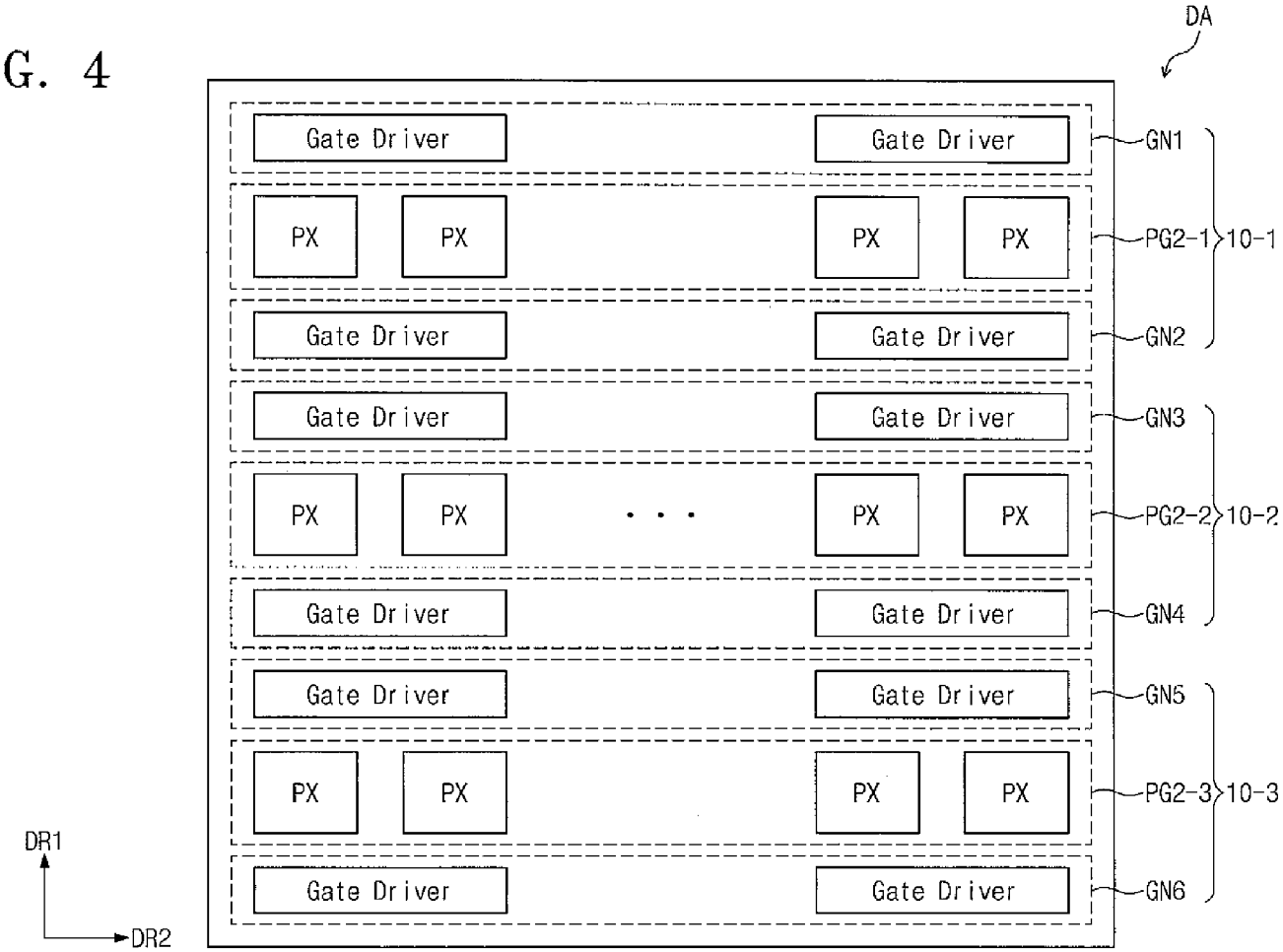
FIG. 4 schematically illustrates a display area according to an embodiment of the inventive concept.

FIG. 4 schematically illustrates a display area according to an embodiment of the inventive concept.

Referring to FIG. 4, gate driving units (e.g., gate drivers) GN1 to GN6 may be disposed together with a plurality of pixels PX on the display area DA. As described above, disposing the gate driving units on the display area DA may allow greater freedom to vary the shape of the display panel 100 and may reduce the bezel width.

On the display area DA, the gate driving units GN1 to GN6 may extend in the second direction DR2, and may be disposed with each other along the first direction DR1. Second pixel groups PG2-1 to PG2-3 may respectively form driving groups 10-1, 10-2, and 10-3, together with first gate driving units GN1, GN3, and GN5, and second gate driving units GN2, GN4, and GN6, which correspond one-to-one with each other. On the display area DA, a plurality of driving groups 10-1 to 10-3 may be disposed with each other along the first direction DR1. In one driving group 10-1, the second pixel group PG2-1 may be disposed between the first and second gate driving units GN1 and GN2. The second pixel group PG2-1 may be driven by receiving gate signals from the corresponding first and second gate driving units GN1 and GN2.

Although not illustrated in FIG. 4, the data driving unit may be disposed in the first direction DR1. In this case, the data driving unit, the gate driving units GN1 to GN6, and the second pixel groups PG2-1 to PG2-3 may be disposed with each other along the first direction DR1.

The data driving unit may be connected to first lines extending in the first direction DRI from the data driving unit so as to transmit data signals to the plurality of pixels PX. The first lines may be disposed between the first pixel groups at every two first pixel groups, and data signals may be transmitted to the first pixel groups respectively disposed at sides (e.g., left and right sides) of the first lines, as described above with reference to FIG. 2.

The gate driving units GN1 to GN6 may be sequentially driven along the first direction DR1. For example, the plurality of driving groups 10-1 to 10-3 may be sequentially driven along the first direction DRI, and in one driving group 10-2, the first and second driving units GN3 and GN4 may be sequentially driven along the first direction DR1.

Therefore, the second gate driving units may respectively receive driving start signals from the first gate driving units, which are included together with the second gate driving units in the same driving groups, and thus, may start to be driven. For example, the second gate driving unit GN4 included in the second driving group 10-2 may receive a driving start signal from the first gate driving unit GN3, which is included together with the second gate driving unit GN4 in the second driving group 10-2.

Furthermore, the first gate driving units may respectively receive driving start signals from the second gate driving units, which are included in previous driving groups, and thus, may start to be driven. For example, the first gate driving unit GN3 included in the second driving group 10-2 may receive a driving start signal from the second gate driving unit GN2 included in the previous driving group, e.g., the first driving group 10-1.

To this end, at least one gate driver included in each of the gate driving units GN1 to GN6 and at least one gate driver included in the next gate driving unit may be dependently connected to each other to transmit a driving start signal. Therefore, second lines, each of which connects a driving start signal output terminal of the previous gate driver with a driving start signal input terminal of the next gate driver, may be disposed on the display area DA.

The second lines may extend in the first direction DR1, and may be disposed between the first pixel groups where the first lines are not disposed in consideration of the aperture ratio of a plurality of pixels and black matrix (BM) regions. A detailed description will be provided below with reference to FIG. 5.

Figure 5:
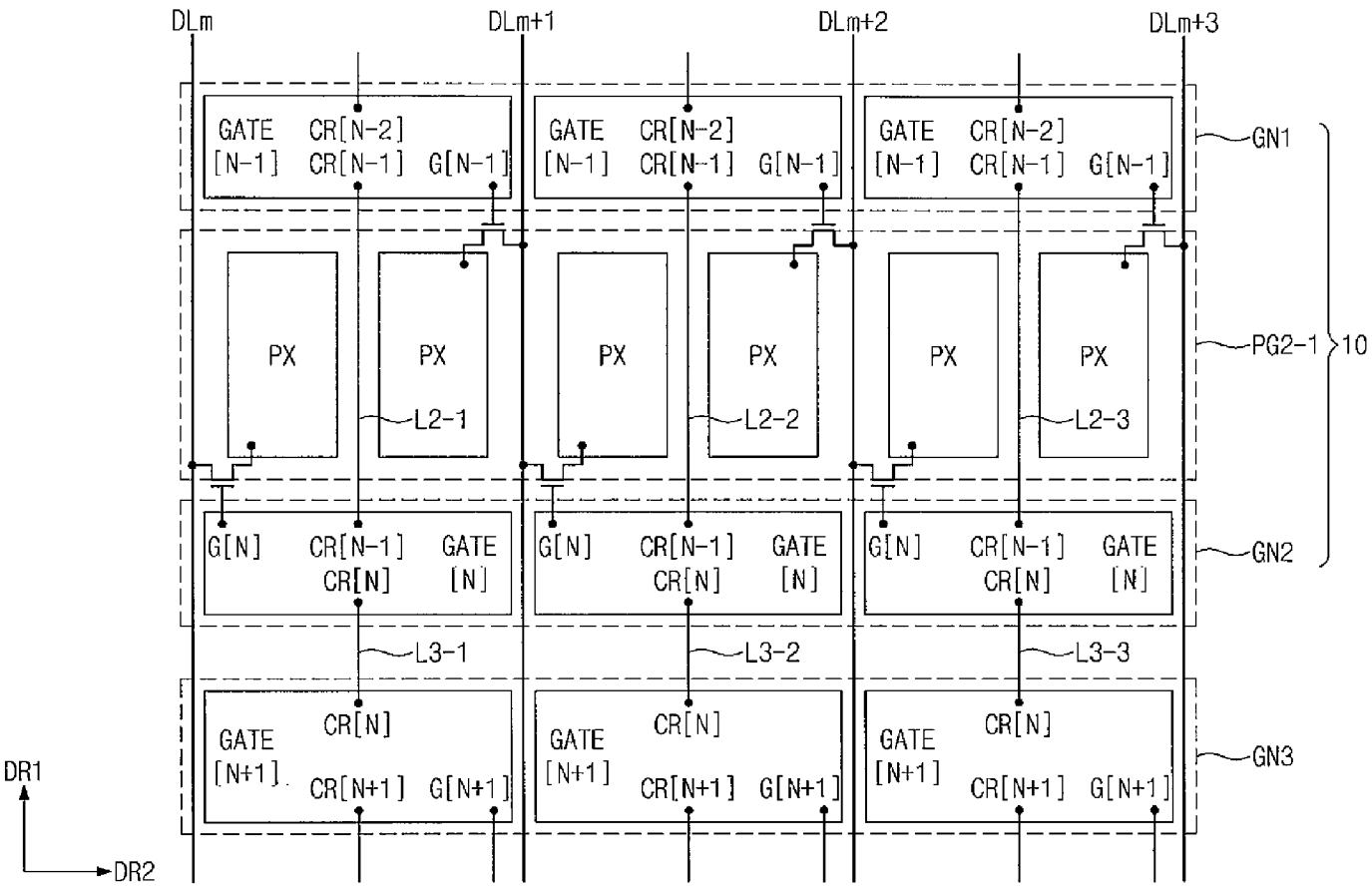
FIG. 5 is an expanded view of a display area illustrated in FIG. 4, according to an embodiment of the inventive concept.

FIG. 5 is an expanded view of a display area illustrated in FIG. 4, according to an embodiment.

Referring to FIG. 5, between the first pixel groups in one driving group 10, first lines DLm to DLm+3 and/or second lines L2-1 to L2-3 may be disposed. For example. In one driving group 10, the first lines DLm to DLm+3 may be disposed between the first pixel groups at every two first pixel groups, and the second lines L2-1 to L2-3 may be disposed between the first pixel groups where the first lines DLm to DLm+3 are not disposed. Therefore, the first and second lines DLm to DLm+3 and L2-1 to L2-3 may respectively face each other with the first pixel groups disposed therebetween.

According to an embodiment of the inventive concept, in one driving group 10, the first and second gate driving units GN1 and GN2 may include at least one gate driver GATE [N−1] corresponding to every two pixels of the plurality of pixels PX included in the second pixel group PG2-1. For example, when the second pixel group PG2-1 includes six plurality of pixels PX, the first and second gate driving units GN1 and GN2 may respectively include three gate drivers GATE[N−1] and three gate drivers GATE[N].

In this case, the three gate drivers GATE[N−1] included in the first gate driving unit GN1 may respectively transmit driving start signals to the three gate drivers GATE[N] included in the second gate driving unit GN2. Therefore, three second lines L2-1 to L2-3 may be utilized, and the three second lines L2-1 to L2-3 may be disposed between the first pixel groups where the first lines DLm to DLm+3 are not disposed. In this case, the first and second lines DLm to DLm+3 and L2-1 to L2-3 may be alternately disposed with each other along the second direction DR2.

The plurality of pixels PX of the inventive concept have such a configuration, as illustrated in FIG. 2, that two first pixel groups are connected to one first line. Therefore, empty spaces are present between the first pixel groups, where the first. lines DLm to DLm+3 are not disposed. According to an embodiment of the inventive concept, the second lines L2-1 to L2-3 for transmitting driving start signals are disposed in these empty spaces, thereby preventing or reducing the expansion of black matrix (BM) regions due to additional line placement, as well as maintaining or substantially maintaining the aperture ratio of the plurality of pixels PX.

However, the inventive concept is not limited to the above-described embodiments, and each of the gate driving units GN1 to GN3 may include various numbers of gate drivers depending on manufacturing purpose, intended use, embedded circuit, and the like. As a result, empty spaces may be present between the first pixel groups, where the first and second lines DLm to DLm+3 and L2-1 to L2-3 are not disposed. That is, a display device, in which the second lines L2-1 to L2-3 for transmitting driving start signals are disposed between the first pixel groups where the first lines DLm to DLm+3 are not disposed, may be only an example embodiment of the inventive concept.

A gate driver GATE[N], which receives a first driving start signal via a second line connected to the previous gate driver GATE[N−1], may start to be driven to output a gate signal and a second driving start signal for starting the driving of the next gate driver GATE[N+1]. At least one pixel PX connected to the gate driver GATE[N] may be driven by the output gate signal.

Furthermore, the display panel of the inventive concept may further include third lines L3-1 to L3-3 for transmitting driving start signals from one driving group to the next driving group. For example, driving start signals may be transmitted via the third lines L3-1 to L3-3 from at least one gate driver GATE[N] included in the second gate driving unit GN2 of one driving group 10 to at least one gate driver GATE[N+1] included in the first gate driving unit GN3 of the next driving group. However, in this case, the second pixel group PG2-1 is not disposed between driving groups, and thus, the aperture ratio of the plurality of pixels and black matrix (BM) regions may not be considered, so that the third lines L3-1 to L3-3 may be disposed in various positions to transmit driving start signals to the next driving group.

The plurality of pixels PX may be respectively connected to the gate drivers GATE[N−1] to GATE[N+1] and the first lines DLm to DLm+3 through thin film transistors. Gate terminals of the thin film transistors may be respectively connected to gate signal output terminals G[N−1] to G[N+1] of the gate drivers GATE[N−1] to GATE[N+1]. Furthermore, first terminals of the thin film transistors may be respectively connected to data lines DLm to DLm+3 corresponding to each pixel PX, and second terminals thereof may be respectively connected to the plurality of pixels PX.

Although the embodiments of the inventive concept are described based on a vertical electric field type pixel structure, the aforementioned description and embodiments may also be similarly applied to a horizontal electric field type pixel structure or a TN-based pixel structure.

According to one or more embodiments of the inventive concept, gate driving units are disposed on a display area, thereby reducing the bezel width. Furthermore, the plurality of pixels and lines for transmitting driving signals are also efficiently disposed on the display area, thereby increasing the aperture ratio of the plurality of pixels and preventing or reducing the expansion of black matrix (BM) regions.

In the drawings, the relative sizes of elements, layers, and regions may be exaggerated for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the inventive concept.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the inventive concept. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the inventive concept refers to "one or more embodiments of the inventive concept." As used herein, the terms "use," "using," and "used" may be considered synonymous with the terms "utilize," "utilizing," and "utilized," respectively. Also, the term "exemplary" is intended to refer to an example or illustration.

The electronic or electric devices and/or any other relevant devices or components according to embodiments of the inventive concept described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the example embodiments of the inventive concept.

For convenience of description, each drawing has been separately described, but it is also possible to design and implement a new embodiment by combining the embodiments described with reference to each drawing. Furthermore, the display device is not restrictively applicable in configurations and methods of the embodiments as described above, but the above-described embodiments may be configured in such a way that some or all of the embodiments are selectively combined so as to make various modifications.

The above-disclosed subject matter is to be considered illustrative and not restrictive, and the appended claims are intended to cover all such modifications, enhancements, equivalents thereof, and other embodiments, which fall within the spirit and scope of the inventive concept. Thus, to the maximum extent allowed by law, the scope of the inventive concept is to be determined by the broadest permissible interpretation of the following claims and their equivalents, and shall not be restricted or limited by the foregoing detailed description.

What is claimed is:

1. A display device comprising:

a display panel having a display area and a non-display area;

a plurality of pixels on the display area, wherein pixels from among the plurality of pixels arranged with each other along a first direction are defined as first pixel groups and pixels from among the plurality of pixels arranged with each other along a second direction are defined as second pixel groups;

gate driving units on the display area and configured to generate gate signals, wherein the gate driving units include first and second gate driving units;

a data driver on the non-display area and configured to generate data signals;

a plurality of first lines configured to transmit the data signals to the plurality of pixels; and a plurality of second lines configured to transmit driving start signals from the first gate driving units to the second gate driving units respectively corresponding to the first gate driving units, wherein the plurality of first and second lines are alternately arranged in the second direction, each of the first pixel groups being disposed between a corresponding one of the first lines and a corresponding one of the second lines, and wherein each of the second pixel groups is disposed between a corresponding one of the first gate driving units and a corresponding one of the second gate driving units.

2. The display device of claim 1, wherein the plurality of first and second lines extend in the first direction.

3. The display device of claim 2, wherein the plurality of first and second lines face each other with the first pixel groups therebetween.

4. The display device of claim 2, wherein the data driver, the gate driving units, and the second pixel groups are arranged with each other along the first direction on the display panel.

5. The display device of claim 4, wherein corresponding ones of the first and second gate driving units are arranged at respective sides of a corresponding one of the second pixel groups.

6. The display device of claim 5, wherein each of the second pixel groups is configured to be driven by receiving the gate signals from the corresponding ones of the first and second gate driving units.

7. The display device of claim 6, wherein the second gate driving units are configured to start to be driven by the driving start signals received from the first gate driving units via the plurality of second lines connected thereto.

8. The display device of claim 7, wherein each of the first and second gate driving units comprises at least one gate driver.

9. The display device of claim 8, wherein each of the gate drivers comprises a driving start signal input terminal, a gate signal output terminal, and a driving start signal output terminal.

10. The display device of claim 9, wherein the driving start signal input terminal of a current gate driver of the gate drivers is configured to receive a first driving start signal from a previous gate driver of the gate drivers via a second line of the second lines connected thereto, and the driving start signal output terminal of the current gate driver is configured to output a second driving start signal to a next gate driver of the gate drivers via a second line of the second lines connected thereto.

11. The display device of claim 10, wherein the previous gate driver, the current gate driver, and the next gate driver are sequentially arranged with each other along the first direction.

12. The display device of claim 1, wherein the first lines are between the first pixel groups, and corresponding ones of the first pixel groups arranged at respective sides of a corresponding one of the first lines are connected to the corresponding one of the first lines arranged between the corresponding ones of the first pixel groups.

13. The display device of claim 12, wherein the corresponding ones of the first pixel groups at the respective sides of the corresponding one of the first lines receive the data signals via the corresponding one of the first lines arranged between the corresponding ones of the first pixel groups.

14. A display device comprising:

a display panel having a display area and a non-display area;

first, second, third, and fourth pixels on the display area;

first and second gate driving units on the display area and configured to generate gate signals;

a data driver on the non-display area and configured to generate data signals;

first and second data lines configured to transmit the data signals to the first to fourth pixels; and second lines configured to transmit driving start signals;

wherein each of the first, second, third, and fourth pixels is disposed between the first data line and the second data line, each of the first and second gate driving units being disposed between the first data line and the second data line, wherein the first and third pixels are arranged in a first direction, the first and second pixels are arranged in a second direction perpendicular to the first direction, and the third and fourth pixels are arranged in the second direction, and wherein the first gate driving unit is connected to one of the first and second pixels, and the second gate driving unit is connected to one of the third and fourth pixels.

15. The display device of claim 14, wherein each of the first and pixels. second gate driving units is disposed between the first pixel and the third pixel, and disposed between the second pixel and the fourth pixel, wherein one of the second lines connects the first gate driving unit to the second gate driving unit, and is configured to transmit one. of the driving start signals from the first gate driving unit to the second driving unit.

16. The display device of claim 15, further comprising fifth and sixth pixels on the display area; and third and fourth gate driving units on the display area and configured to generate the gate signals, wherein the first, third, and fifth pixels are arranged in the first direction, the fifth and sixth pixels are arranged in the second direction, and the first pixel is disposed between the third pixel and the fifth pixel, wherein the third gate driving unit is connected to one of the fifth and sixth pixels, and the fourth gate driving unit is connected to the other of the first and second pixels, wherein the other of the second lines connects the first gate driving unit and the fourth gate driving unit, and is configured to transmit the other of the driving start signals from the fourth gate driving unit to the first driving unit, and wherein the other of the second lines is disposed between the first pixel and the second pixel.

17. The display device of claim 16, wherein each of the first and second gate driving units is disposed between the first pixel and the third pixel, and disposed between the second pixel and the fourth pixel, wherein each of the third and fourth gate driving units is disposed between the first pixel and the fifth pixel, and disposed between the second pixel and the sixth pixel.

* * * * *